United States Patent [19]

Hoshino et al.

[11] 4,405,390

[45] Sep. 20, 1983

[54] HIGH STRENGTH STAINLESS STEEL HAVING EXCELLENT INTERGRANULAR CORROSION CRACKING RESISTANCE AND WORKABILITY

[75] Inventors: Kazuo Hoshino; Teruo Tanaka; Keiichi Tachibana, all of Yamaguchi, Japan

[73] Assignee: Nisshin Steel Company, Ltd., Japan

[21] Appl. No.: 396,395

[22] Filed: Jul. 8, 1982

[30] Foreign Application Priority Data

Jul. 8, 1981 [JP] Japan ..... 56-105673

[51] Int. Cl.[3] ..... C22C 38/40

[52] U.S. Cl. ..... 148/37; 75/128 N; 75/128 A

[58] Field of Search ..... 75/128 N, 128 A, 128 R; 148/37

[56] References Cited

U.S. PATENT DOCUMENTS 1,990,590 2/1935 Franks ..... 75/128 N 2,602,737 7/1952 Binder et al. ..... 75/128 N

*Primary Examiner*—L. Dewayne Rutledge

*Assistant Examiner*—Debbie Yee

*Attorney, Agent, or Firm*—Webb, Burden, Robinson & Webb

[57] ABSTRACT

A high strength stainless steel having the composition in % by weight of C: not more than 0.04%, N: 0.04–0.20%, Si: not more than 1.0%, Mn: not more than 2.0%, Ni: 6.0–10.0%, Cr: 16.0–20.0% and balance Fe and impurities inevitably incidental from the steelmaking process, and that the composition is adjusted to have an Aγ value of 19–21, where: Aγ=(%Ni)+0.60 (%Cr)+0.7 (%Mn)+13 [(%C)+(%N)], is disclosed. The steel exhibit excellent intergranular corrosion cracking resistance and workability as well as high strength.

1 Claim, 2 Drawing Figures

HIGH STRENGTH STAINLESS STEEL HAVING EXCELLENT INTERGRANULAR CORROSION CRACKING RESISTANCE AND WORKABILITY

TECHNICAL FIELD OF THE INVENTION

This invention relates to a high strength stainless steel provided with excellent intergranular corrosion cracking resistance in the cold-worked state and in the welds when the steel is welded after cold-working, as well as excellent workability.

BACKGROUND OF THE INVENTION

High strength stainless steels provided with corrosion resistance which is one of the characteristics inherent to the stainless steel as well as considerably high strength properties. High strength stainless steels should, of course, be of high strength. But also it is most desired that they are excellent in workability and weldability including various properties of the welds, since they are generally subject to working and welding when they are used. Also it is a matter of course that they should be excellent in corrosion resistance which is one of the inherent characteristics of stainless steel. It is not easy to obtain all these properties simultaneously. (One of the difficulties is the incompatibility of strength and workability.) However, there are some fields in which high strength stainless steel materials satisfactorily provided with all of the above-mentioned properties are required. One of such fields is rolling stock.

Because of their excellent corrosion resistance, more and more high strength stainless steels are being used nowadays for rolling stock, whereas plain carbon steel was largely used in the past. Plain carbon steel is not satisfactory in that it is inferior in corrosion resistance and strength, and therefore it requires considerable cost for maintenance, such as periodical painting etc., and considerably thick plates must be used to compensate for its inferior strength, which makes the vehicles heavier. This runs counter to the current general demand to save material and energy consumption. In order to overcome these disadvantages of plain carbon steel, use of stainless steels having excellent corrosion resistance as well as high strength is desired. When stainless steel is used, the rolling stock can be made lighter by employment of thinner plates and the need for troublesome maintenance work, including painting, can be eliminated. Further, stainless steel is more durable than plain carbon steel, and its use is advantageously meets the demand for the saving of material and energy in various respects. Thus, there is now being seen a switchover of the material for rolling stock from plain carbon steel to high strength stainless steel, and this trend is expected to increase.

When railroad vehicles are constructed, cold-rolled plates of various thicknesses are formed into complicated shapes, and therefore, the plates must be of high strength and at the same time must be provided with good ductility and workability in the cold-rolled state. Further, the shaped plates are fabricated by means of welding, so they must be excellent in weldability, too. With respect to workability, it is important that the plates be satisfactory in elongation and bending. With respect to weldability, mechanical strength of the weld is, of course, the most important factor. But intergranular corrosion cracking caused by sensitization of the welds is especially significant. As has been observed in the foregoing, the materials for railroad vehicles must be provided with various characteristics simultaneously and must be more satisfactory than in the case of steels for general use. More specifically, materials for railroad vehicles are required to have excellent workability, considerably good work-hardening property (not more than 0.8 in yield ratio (yield-to-tensile strength ratio)) and excellent intergranular corrosion cracking resistance in the welds, in addition to being of high strength.

Although materials now in use for railroad vehicles are satisfactory in strength and workability, they incur problems in intergranular corrosion cracking in many cases. It is known that this cracking is localized to sensitized areas of the welding heat-affected zone, and runs along the grain boundaries. This means that this cracking is due to the high intergranular corrosion sensitivity of the material, whether it is caused by the pure intergranular corrosion or by the stress corrosion under the remaining welding strain. The reason why the conventional high strength strainless steels have high intergranular corrosion sensitivity is thought to be that the conventional high strength stainless steels contain 0.05–0.12% carbon in order to attain high strength and good workability, and are used in the cold-rolled state. That is, the fact per se that they contain high carbon and the fact that the high carbon content promotes intergranular corrosion susceptibility when the material is cold-rolled account for the high sensitivity to intergranular corrosion cracking of these steels.

The purpose of this invention is to provide a high strength stainless steel which is free from high sensitivity to intergranular corrosion cracking of welds, which is inherent in the conventional high strength stainless steels, and that is possessed of strength, workability, etc. higher than those of the conventional high strength stainless steels.

For this purpose, primarily with the aim to reduce the intergranular corrosion sensitivity of welds and sensitization of cold-rolled plates, we have carried out an extensive experimental study in order to ascertain whether the above-mentioned sensitivity and the sensitization can be reduced with high strength and good workability retained by reducing the carbon content and in its stead adding nitrogen, which strengthens the solid solution phase like carbon. We have found that by reducing the carbon content and adding nitrogen, sensitization of cold worked plates, that is, sensitivity to intergranular corrosion cracking of the conventional high strength stainless steel can be reduced while retaining strength and workability required for railroad vehicle materials, if the composition of the steel is adjusted with respect to stability of the austenite phase.

Disclosure of the Invention

On the basis of this finding, we have determined the composition of a high strength stainless steel with excellent intergranular corrosion cracking resistance without sacrificing strength properties and workability. The specific composition range (% by weight) of the thus found high strength stainless steel with adjusted composition is as follows:

C: not more than 0.04%
N: 0.04–0.20%
Si: not more than 1.0%
Mn: not more than 2.0%
Ni: 6.0–10.0%
Cr: 16.0–20.0%

Balance: Fe and impurities inevitably involved in the process of steelmaking wherein the Aγ value defined as:

$$A\gamma=(-\%Ni)+0.60(\%Cr)+0.70(\%Mn)+13.0[(\%C)+(-\%N)]$$ is 19–21.

The process for producing the steel of this invention is not particularly different from the process of production of ordinary stainless steels. That is, the carbon content is reduced to 0.04% or less under the atmospheric pressure or by vacuum degassing. Nitrogen is introduced into the steel by addition of manganese nitride or chromium nitride under the atmosphere or under the argon blanket, or otherwise by blowing nitrogen directly into the molten steel. After the melt is cast, the steel is made into cold-rolled sheets by the same process as with the ordinary stainless steel.

The reasons for defining the composition range as above are as follows.

C and N: The intergranular corrosion resistance property of the cold-rolled plates is scarcely influenced by N, but it is determined by the C content. The C content is restricted to not more than 0.04% because, if it is in excess of this value, the intergranular corrosion susceptibility becomes remarkable. Nitrogen is one of the characteristic components of the steel of this invention. As mentioned above, N, an element that, like carbon, strengthens solid solution phase, is added instead of C in order to improve the intergranular corrosion resistance. From consideration given to the generation of blow holes when the steel solidifies, and other matters in steelmaking, the upper limit of the N content is restricted to 0.20%. On the other hand the lower limit is defined as 0.04%, since the desired strength, workability and ductility cannot simultaneously be satisfied with a N content of less than 0.04%.

Si: Si is an essential element which is added to the steel as a deoxidation agent in the course of steelmaking. The content is, however, limited to not more than 1.0%, since a content in excess of this value leads to the formation of δ-ferrite phase and deteriorates the hot workability of the steel.

Mn: Mn is added to the steel as deoxidation agent and as a workability improver. However, if this element is added in a large amount, the surface quality of the plates is impaired by oxide scale of an undesirable nature formed in the course of annealing, which is an indispensable step in the manufacturing process. The content is limited to not more than 2.0%.

Cr: The Cr content is defined as 16.0–20.0%. At least 16% Cr is necessary in order to secure the corrosion resistance property inherent to stainless steel. On the other hand, addition of 20% or more Cr remarkably increases formation of δ-ferrite phase, resulting in deterioration of hot workability.

Ni: Ni, which inhibits formation of δ-ferrite phase, must be increasingly added as the Cr content increases. However, if a large amount of Ni is incorporated, the γ-phase is excessively stabilized and thus the yield ratio ($\sigma_{0.2}/\sigma_B$) becomes high. This means deterioration in workability and rise in manufacturing cost. In consideration of the austenite stability, the Ni content is defined as 6.0–10.0%.

Austenite stability: In the class of metastable austenite stainless steels, to which the steel of this invention belongs, high strength is achieved by hardening due to the transformation of the austenite phase to martensite when the material is worked as well as by work hardening per se. The austenite stability index Aγ defined as:

$$A\gamma=(-\%Ni)+0.60(\%Cr)+0.70(\%Mn)+13.0[(\%C)+(\%N)]$$ must be 19–21. When the Aγ value is less than 19, the γ-phase is so unstable that the elongation property of the material is extremely low, which means poor ductility and workability, although high strength is acquired. On the other hand, when the Aγ value is in excess of 21, the γ-phase is so stable that the yield ratio ($\sigma_{0.2}/\sigma_B$) becomes high and workability is impaired. Thus the Aγ value representing austenite stability is defined as 19–21. The coefficient for each comonent has been experimentally confirmed in this invention. Steel sheets of various compositions were prepared by cold rolling with reduction of 15% and 25% under the same conditions except reduction. Amounts of martensite in these sheet samples and the correlation between martensite amounts and compositions was sought after and the coefficient of each element was determined assigning 1 as the coefficient for Ni. That is, the coefficients in the formula of Aγ were determined from the relation between the amount of working-induced martensite and the composition. The reason why the austenite stability index Aγ must be in this range will be apparent from the following description.

In the working of this invention, a preferable composition is as follows. The C content is not more than 0.03%, the N content is 0.04–0.17%, the Si content is not more than 0.8%, the Mn content is not more than 1.75% and the contents of the remaining elements are the same as above. In a more preferable composition, the C content is not more than 0.02%, the N content is 0.04–0.12%, the Si content is not more than 0.7%, the Mn content is not more than 1.5% and the contents of the remaining elements are the same as above.

A preferred Aγ value is 19.5–20.5%.

Now the invention is explained in detail by way of working example with reference to the attached drawings.

DETAILED DESCRIPTION OF THE EMBODIMENTS OF THE INVENTION

Figure 1:
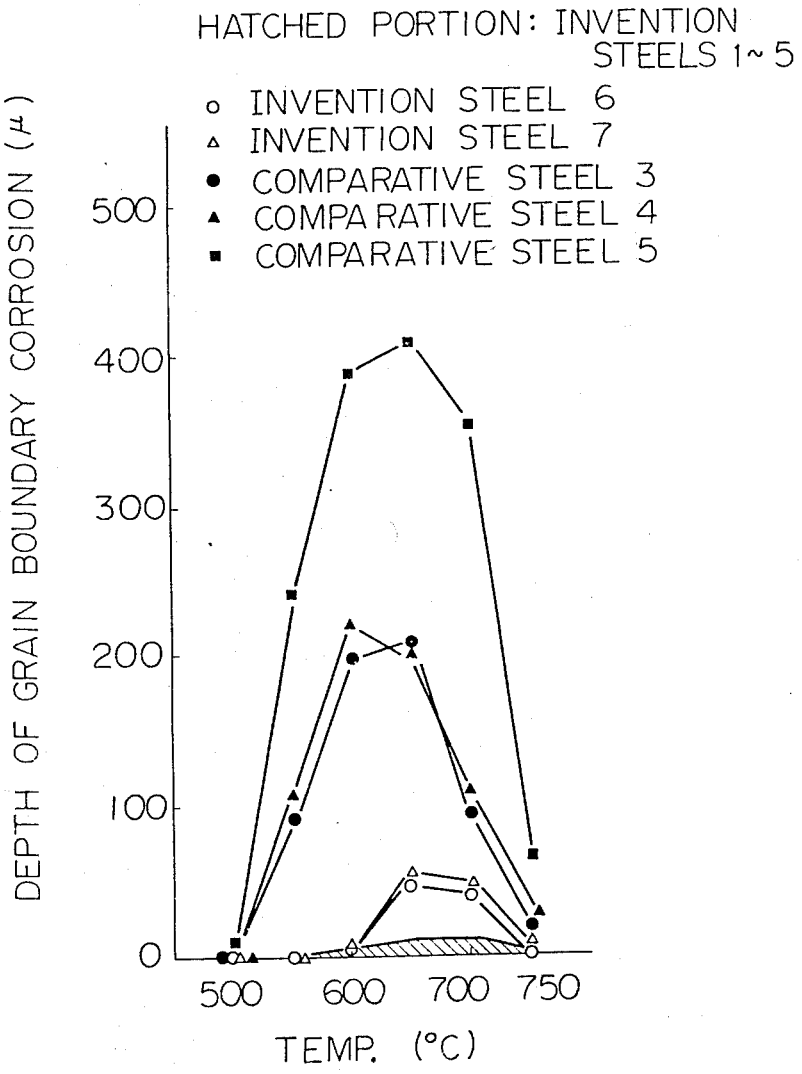
FIG. 1 and 2 are diagrams showing depth of intergranular corrosion in steels of this invention and comparative steels which are rolled with 15% and 25% reduction and were subjected to aging at 500°–750° C.
Figure 2:
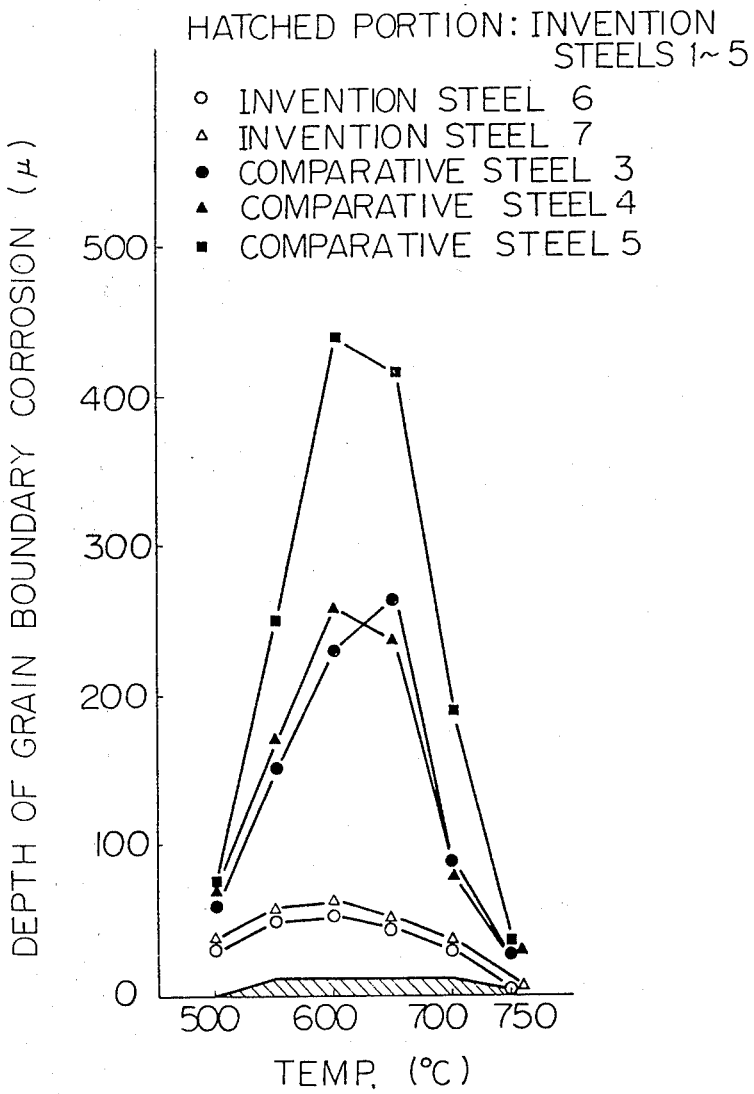

Steels of this invention and comparative steels the compositions of which are shown in Table 1 were respectively forged from a 50 kg ingot and formed into sheets 1.18 mm and 1.33 mm in thickness by conventional cold-rolling and annealing. These sheets were finally cold-rolled at 70° C. into 1.0 mm thick sheets with reduction of 15% and 25%. (In the above-mentioned preparation of steel sheet samples, forging was employed as the hot working. This is because a small 50 kg ingot were made in a laboratory. In the commercial operation, however, sheets are manufactured by casting, hot rolling and cold rolling and annealing as well known.) These final sheets were subjected to the tensile test and the test for sensitization characteristics at room temperature. Sensitization characteristics were tested by subjecting the cold-rolled sheets which had been reduced to 1.0 mm in thickness to sensitization heat treatment which comprises heating samples at 500°–750° C. for 30 minutes and air-cooling the same, then subjecting them to immersing in boiling Strauss solution for 16 hours and the grain boundary oxidation heat treatment at 1100° C. for 10 minutes followed by air-cooling, and finally measuring the intergranular corrosion depth of each sample. The results of the tensile test are shown in Table 2 and the results of the sensitization characteristic test are shown in FIGS. 1 and 2.

TABLE 1

| | C | Si | Mn | Ni | Cr | N | $A\gamma$ |
|---|---|---|---|---|---|---|---|
| Invention | | | | | | | |
| Steels 1 | 0.008 | 0.79 | 1.48 | 7.48 | 17.35 | 0.102 | 20.4 |
| Steels 2 | 0.018 | 0.66 | 1.73 | 7.54 | 17.83 | 0.073 | 20.6 |
| Steels 3 | 0.020 | 0.63 | 1.66 | 7.15 | 17.64 | 0.093 | 20.4 |
| Steels 4 | 0.017 | 0.67 | 1.74 | 7.80 | 17.73 | 0.049 | 20.5 |
| Steels 5 | 0.019 | 0.54 | 1.44 | 6.62 | 17.16 | 0.118 | 19.7 |
| Steels 6 | 0.032 | 0.61 | 1.05 | 7.13 | 16.78 | 0.170 | 20.6 |
| Steels 7 | 0.038 | 0.51 | 0.95 | 6.57 | 16.82 | 0.140 | 19.6 |
| Comparative | | | | | | | |
| Steels 1 | 0.017 | 0.78 | 1.40 | 6.67 | 16.71 | 0.079 | 18.9 |
| Steels 2 | 0.035 | 0.45 | 1:03 | 7.54 | 18.05 | 0.140 | 21.4 |
| Steels 3 | 0.038 | 0.47 | 1.00 | 8.46 | 18.22 | 0.081 | 21.6 |
| Steels 4 | 0.061 | 0.54 | 1.16 | 6.88 | 17.41 | 0.072 | 19.9 |
| Steels 5 | 0.066 | 0.49 | 1.91 | 7.47 | 16.68 | 0.041 | 20.2 |
| Steels 6 | 0.094 | 0.55 | 1.90 | 7.76 | 16.74 | 0.017 | 20.6 |

C content is 0.06–0.07%, intergranular corrosion cracking increases when the cold rolling reduction is increased from 15% to 25%. In contrast, even in Invention Steels 6 and 7, which contain C in an amount close to the upper limit defined in this invention (0.03% or more), the absolute amount of intergranular corrosion cracking over the full sensitizing temperature range is almost constant, although intergranular corrosion cracking increases on the lower temperature side. Further it is no exaggeration to say that the steels of this invention containing 0.02% or less C as exemplified by Invention Steels 1–5 are not sensitized even if they are cold-rolled.

As has been observed in the above working examples, the steels of this invention are provided with various characteristics required of high strength stainless steel, and thus this invention will expand the fields of utilization of high strength stainless steels. Especially in the field of rolling stock, in which extensive use of the high stainless strength steel is expected, the steels of this invention will be advantageously used, since the intergranular corrosion cracking resistance is remarkably improved while the mechanical strength, workability, etc. required of a material for rolling stock are retained.

TABLE 2

| | 15% Rolled Plates | | | | 25% Rolled Plates | | | |
|---|---|---|---|---|---|---|---|---|
| | $\sigma_{0.2}$ (kg/mm$^2$) | $\sigma_B$ (kg/mm$^2$) | $\sigma_{0.2}/\sigma_B$ | Elongation (%) | $\sigma_{0.2}$ (kg/mm$^2$) | $\sigma_B$ (kg/mm$^2$) | $\sigma_{0.2}/\sigma_B$ | Elongation (%) |
| Invention | | | | | | | | |
| Steels 1 | 59.8 | 93.5 | 0.64 | 33.8 | 79.1 | 103.0 | 0.77 | 26.8 |
| Steels 2 | 55.7 | 89.2 | 0.62 | 35.0 | 76.8 | 97.6 | 0.78 | 27.2 |
| Steels 3 | 61.2 | 96.2 | 0.64 | 31.8 | 80.3 | 107.2 | 0.75 | 25.1 |
| Steels 4 | 56.8 | 88.1 | 0.64 | 32.5 | 72.8 | 96.0 | 0.76 | 26.8 |
| Steels 5 | 57.0 | 103.0 | 0.55 | 28.0 | 74.2 | 113.0 | 0.65 | 22.9 |
| Steels 6 | 65.7 | 99.5 | 0.66 | 35.0 | 86.0 | 109.2 | 0.79 | 27.5 |
| Steels 7 | 65.0 | 105.1 | 0.62 | 32.5 | 83.0 | 114.0 | 0.73 | 26.2 |
| Comparative | | | | | | | | |
| Steels 1 | 60.1 | 108.2 | 0.55 | 21.0 | 86.0 | 119.2 | 0.72 | 15.1 |
| Steels 2 | 62.2 | 87.1 | 0.71 | 37.1 | 88.1 | 103.1 | 0.85 | 26.2 |
| Steels 3 | 57.0 | 74.9 | 0.76 | 34.2 | 83.8 | 98.0 | 0.89 | 25.8 |
| Steels 4 | 65.5 | 104.0 | 0.63 | 31.2 | 88.5 | 120.0 | 0.74 | 24.3 |
| Steels 5 | 63.0 | 101.1 | 0.62 | 32.3 | 85.7 | 118.1 | 0.73 | 24.6 |
| Steels 6 | 64.3 | 94.8 | 0.67 | 35.1 | 81.2 | 103.5 | 0.78 | 27.1 |

It is apparent from Table 2 that the steels of this invention are superior to Comparative Steels 1, 2 and 3 in the comprehensive tensile properties required of the high strength steel materials. That is, from all of the steels of this invention, sheets which satisfy the mechanical property conditions required of the ½ hard material for railroad vehicles ($\sigma_{0.2}$:70 kg/mm$^2$ or more, $\sigma_B$: 94 kg/mm$^2$ or more, $\sigma_{0.2}/\sigma_B \leqq 0.8$, El $\geqq$ 20) can be satisfactorily manufactured with 15–25% reduction. In contrast, it can be seen in Comparative Steel 1 that when the $A\gamma$ value is 18.9, the material is inferior in ductility and workability because of instability of the $\gamma$-phase, even though the strength is satisfactory. That is to say, although the $\sigma_{0.2}$ of the material is 70 kg/mm$^2$ or more, the elongation is 20% or less. Comparative Steels 2 and 3, wherein the $A\gamma$ value is in excess of 21, have high $\sigma_{0.2}$ values but their $\sigma_b$ values are not so high, since the $\gamma$-phase is too stable. The yield strength ratio is 0.8 or more, which means poor workability in the same way as in the case of unstable $\gamma$-phase.

It is apparent from the results shown in FIG. 1 and 2 that Invention Steels are much improved in sensitization characteristics in comparison with Comparative Steels 4, 5 and 6. In Comparative Steels 3 and 4, wherein the

Industrial Applicability

From the foregoing description it is obvious that the product of this invention is advantageously used as the material for manufacturing railroad vehicles. However, the applicability of the steel of this invention is not limited thereto but wide use in various industrial fields is expected.

We claim:

1. A wrought high strength rolling stock stainless steel material having excellent intergranular corrosion cracking resistance and workability and a composition in % by weight consisting essentially of C: not more than 0.03%, N: 0.04–0.12%, Si: not more than 0.7%, Mn: not more than 1.75%, Ni: 6.0–10.0%, Cr: 16.0–20.0% and balance Fe and impurities inevitably incidental from the steelmaking process, and that the composition is adjusted to have an $A\gamma$ value of 19.5–20.5; where:

$$A\gamma = (\%Ni) + 0.60(\%Cr) + 0.70(\%Mn) + 13[(\%C) + (\%N)].$$

* * * * *